US011299380B2

(12) United States Patent
Narayanan et al.

(10) Patent No.: US 11,299,380 B2
(45) Date of Patent: Apr. 12, 2022

(54) CONVERTIBLE CARRIAGE

(71) Applicant: Deere & Company, Moline, IL (US)

(72) Inventors: Arun Narayanan, East Moline, IL (US); David M. O'Brien, Asbury, IA (US); Jason M. Simmons, Platteville, WI (US)

(73) Assignee: Deere & Company, Moline, IL (US)

( * ) Notice: Subject to any disclaimer, the term of this patent is extended or adjusted under 35 U.S.C. 154(b) by 52 days.

(21) Appl. No.: 17/007,977

(22) Filed: Aug. 31, 2020

(65) Prior Publication Data

US 2022/0063971 A1 Mar. 3, 2022

(51) Int. Cl.

| | |
|---|---|
| ***B66F 9/12*** | (2006.01) |
| *B66F 9/065* | (2006.01) |
| *E02F 3/96* | (2006.01) |

(52) U.S. Cl.

CPC ..... *B66F 9/12* (2013.01); *B66F 9/065* (2013.01); *E02F 3/96* (2013.01)

(58) Field of Classification Search

CPC .. B66F 9/12; B66F 9/125; B66F 9/145; B66F 9/147; B66F 9/149; B66F 9/065; E02F 3/96; Y10T 403/32254; Y10T 403/7073; Y10T 403/7075

See application file for complete search history.

(56) References Cited

U.S. PATENT DOCUMENTS

| | | | | | |
|---|---|---|---|---|---|
| 2,975,924 | A * | 3/1961 | Kopanski | B66F 9/12 | 414/785 |
| 3,851,779 | A * | 12/1974 | Crawford | B66F 9/12 | 414/667 |
| 4,024,973 | A * | 5/1977 | Siderits | B66F 9/082 | 414/635 |
| 4,497,607 | A * | 2/1985 | Johannson | B66F 9/12 | 414/664 |
| 5,230,600 | A * | 7/1993 | Marino | B66F 9/12 | 414/607 |
| 9,156,666 | B2 * | 10/2015 | Romigh | B66F 9/125 | |
| 10,023,449 | B1 * | 7/2018 | Knoll | B66F 9/142 | |
| 10,501,297 | B2 * | 12/2019 | Wright | B66F 9/144 | |
| 2010/0101895 | A1 * | 4/2010 | Collins | B66F 9/142 | 187/237 |

* cited by examiner

*Primary Examiner* — Michael A Riegelman

(57) ABSTRACT

A convertible carriage is provided. The convertible carriage includes a carriage frame, a support arrangement, a shaft, and a retaining arrangement. The support arrangement includes an elongate slot and is positioned on the carriage frame. The shaft may carry a tine and is moveable along the elongate slot at least in a vertical dimension. The retaining arrangement may selectively engage with the elongate slot. When the retaining arrangement is engaged with the elongate slot, a movement of the shaft is limited by the retaining arrangement with a boundary defined at least by the retaining arrangement. When the retaining arrangement is removed from the elongate slot, the shaft is allowed to float in the elongate slot.

20 Claims, 14 Drawing Sheets

CONVERTIBLE CARRIAGE

RELATED APPLICATIONS

N/A.

FIELD OF THE DISCLOSURE

The present disclosure relates generally to a carriage which include folk tines to lift objects.

BACKGROUND OF THE DISCLOSURE

A work vehicle such as a loader, wheel loader, forklift truck, may be used to lift or pry an object in the construction site, field or other occasions. The object for example, can be pieces of concrete, asphalt slabs, trees, etc. A carriage which carries (folk) tines is therefore equipped on the work vehicle. In operation, the tines may be inserted into a pallet, the top of which rested on the object. Alternatively, the tines may directly be inserted beneath the object to reposition the object.

SUMMARY OF THE DISCLOSURE

A convertible carriage is provided. The convertible carriage includes a carriage frame, a support arrangement, a shaft, and a retaining arrangement. The support arrangement includes an elongate slot and is positioned on the carriage frame. The shaft may carry a tine and is moveable along the elongate slot at least in a vertical dimension. The retaining arrangement may selectively engage with the elongate slot. When the retaining arrangement is engaged with the elongate slot, a movement of the shaft is limited by the retaining arrangement with a boundary defined at least by the retaining arrangement. When the retaining arrangement is removed from the elongate slot, the shaft is allowed to float in the elongate slot.

In one aspect of the disclosure, the retaining arrangement comprises a retainer engaged with one of an upper portion of the elongate slot to limit the shaft from moving upward or a lower portion of the elongate slot to limit the shaft from moving downward when the retaining arrangement is engaged with the elongate slot.

In one aspect of the disclosure, the retainer comprises an edge corresponding to a curvature of the shaft.

In one aspect of the disclosure, the retainer is engaged with the elongate slot and the shaft via a press-fit.

In one aspect of the disclosure, the retaining arrangement comprises a retainer and a holding piece coupled to the retainer, and the holding piece and the retainer cooperate to form a retaining slot through which the shaft is positioned.

In one aspect of the disclosure, when the retaining arrangement is engaged with the elongate slot. The holding piece is coupled to the carriage frame via a second fastener, and the retainer is engaged with the elongate slot.

In one aspect of the disclosure, the convertible carriage may include a shaft collar coupled to an end of the shaft so as to lock the shaft. The holding piece is positioned between the shaft collar and the carriage frame when the retaining arrangement is engaged with the elongate slot.

In one aspect of the disclosure, the holding piece comprises a lock unit configured to lock the shaft.

In one aspect of the disclosure, the holding piece comprises a first rib and a second rib opposite to the first rib. The first rib and the second rib partially define the retaining slot. The lock unit comprises a first lock hole of the first rib and a second lock hole of the second rib, and a first fastener positioned through the first lock hole, the shaft, and the second lock hole.

In one aspect of the disclosure, the retaining slot and the elongate slot define the boundary.

In one aspect of the disclosure, the retaining arrangement comprises a retainer and a shaft collar coupled to the retainer. The shaft collar is coupled to an end of the shaft so as to lock the shaft, and the retainer is configured to be engaged with the elongate slot so as to define the boundary.

In one aspect of the disclosure, the support arrangement includes a reinforcing plate mounting on the carriage frame, and the reinforcing plate comprises the elongate slot.

In one aspect of the disclosure, the carriage frame comprises a set comprising a first member and a second member. The support arrangement comprises a first elongate slot positioned on the first member and a second elongate slot positioned on the second member. The shaft is positioned through the first elongate slot and second elongate slot and is moveable along the first elongate slot and the second elongate slot at least in the vertical dimension.

In one aspect of the disclosure, the carriage frame comprises another set comprising the first member and the second member with another shaft positioned through.

A retaining arrangement is provided. The retaining arrangement is selectively coupled to a convertible construction carriage having a carriage frame, an elongate slot positioned on the carriage frame, and a shaft configured to carry a tine and to be moveable along the elongate slot at least in a vertical dimension. The retaining arrangement may include a retainer configured to be engaged with one of an upper portion of the elongate slot to limit the shaft from moving upward or a lower portion of the elongate slot to limit the shaft from moving downward.

In one aspect of the disclosure, the retaining arrangement comprise a holding piece coupled to the retainer. The holding piece and the retainer cooperate to form a retaining slot through which the shaft is positioned.

In one aspect of the disclosure, the holding piece is coupled to the carriage frame via a second fastener when the retainer is engaged with the elongate slot.

In one aspect of the disclosure, the holding piece comprises a lock unit configured to lock the shaft.

In one aspect of the disclosure, the holding piece comprises a first rib and a second rib opposite to the first rib, and the first rib and the second rib partially define the retaining slot. The lock unit comprises a first lock hole of the first rib and a second lock hole of the second rib, and a first fastener positioned through the first lock hole, the shaft, and the second lock hole.

In one aspect of the disclosure, the retaining arrangement comprises a retainer and a shaft collar coupled to the retainer. The shaft collar is coupled to an end of the shaft so as to lock the shaft. The retainer is configured to be engaged with the elongate slot so as to define the boundary.

Other features and aspects will become apparent by consideration of the detailed description and accompanying drawings.

BRIEF DESCRIPTION OF THE DRAWINGS

The detailed description of the drawings refers to the accompanying figures in which.

DETAILED DESCRIPTION OF THE DRAWINGS

There are two types of carriage frames which may have different structures in respect to how shaft(s) thereof coupled to the carriage frames. As to the first type of carriage frame, which is a fixed tine frame, tines coupled to a shaft cannot move vertically while the carriage frame is in operation. The tines may provide better down pressure. As to the second type of carriage frame, which is a floating tine frame, tines coupled to a shaft is moveable in vertical dimension while the carriage frame is in operation. The floating tine frame may be suitable for the work vehicle to operate in an uneven terrain. For example, when the tines pick up or remove pallets on an uneven terrain, the tines may move upward in different extent, due to the reaction from the ground. The present disclosure includes a retaining arrangement(s) selectively coupled to a floating tine frame to make it as a convertible carriage. The convertible carriage here may be operated in a first mode and a second mode. In the first mode, the retaining arrangement(s) is not engaged with the carriage frame such that the shaft is able to float. In the second mode, the retaining arrangement(s) is engaged with the carriage frame; the movement of the shaft is limited in certain extent. An example of the second mode is that the shaft is fixed when the retaining arrangement(s) is engaged. The details are described below.

Figure 1:
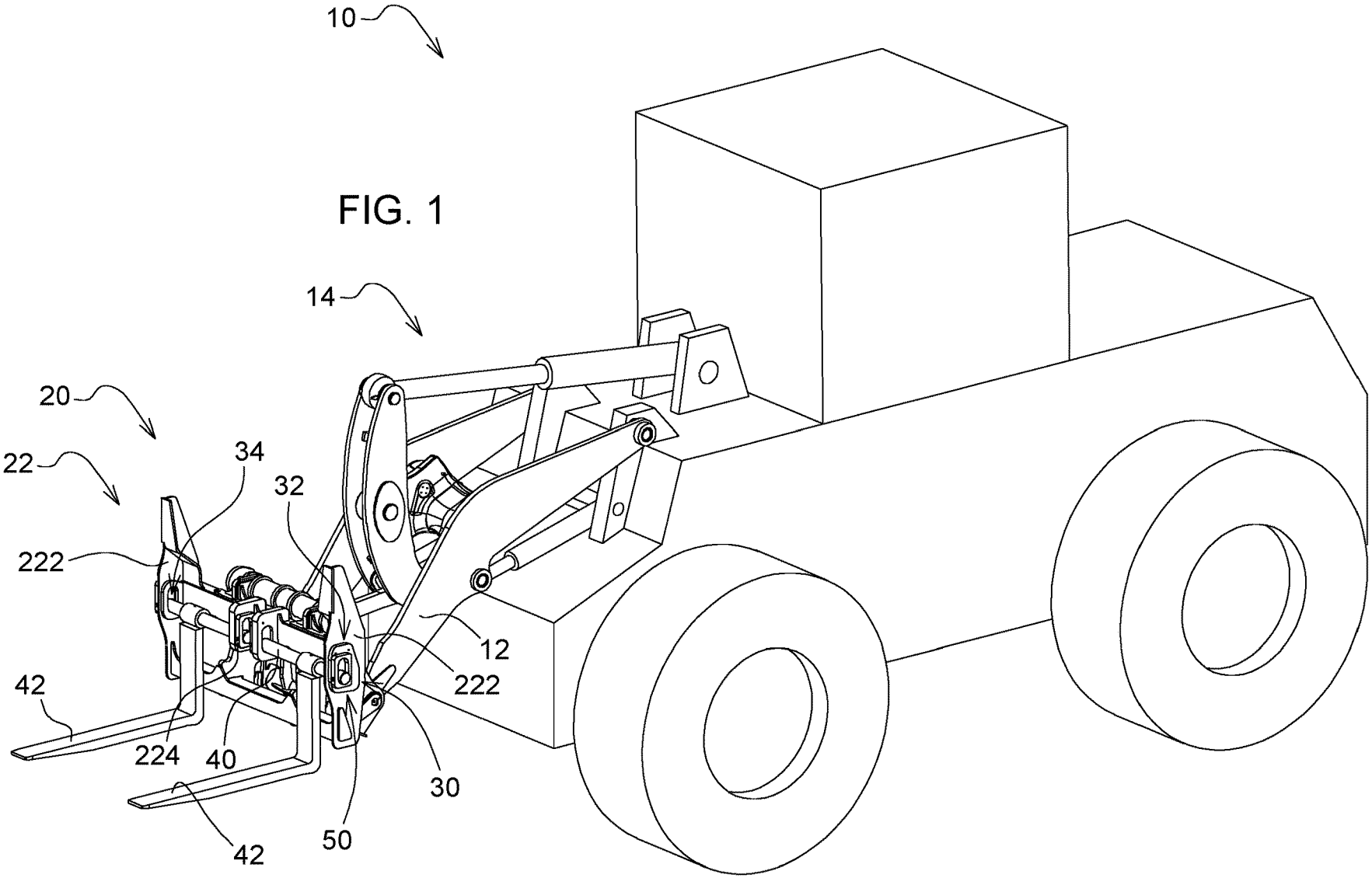
FIG. 1 is a perspective view of a work vehicle with a carriage.

Referring to FIG. 1, a work vehicle 10 connects a convertible carriage 20. The work vehicle 10 can be used in different types of occasions, such as construction site, farm, and warehouse. The work vehicle 10 can be a loader, wheel loader, backhoe, forklift (fork truck), tractor, or other vehicle that has arms 12 and/or actuators 14 to lift the convertible carriage 20.

Figure 2A:
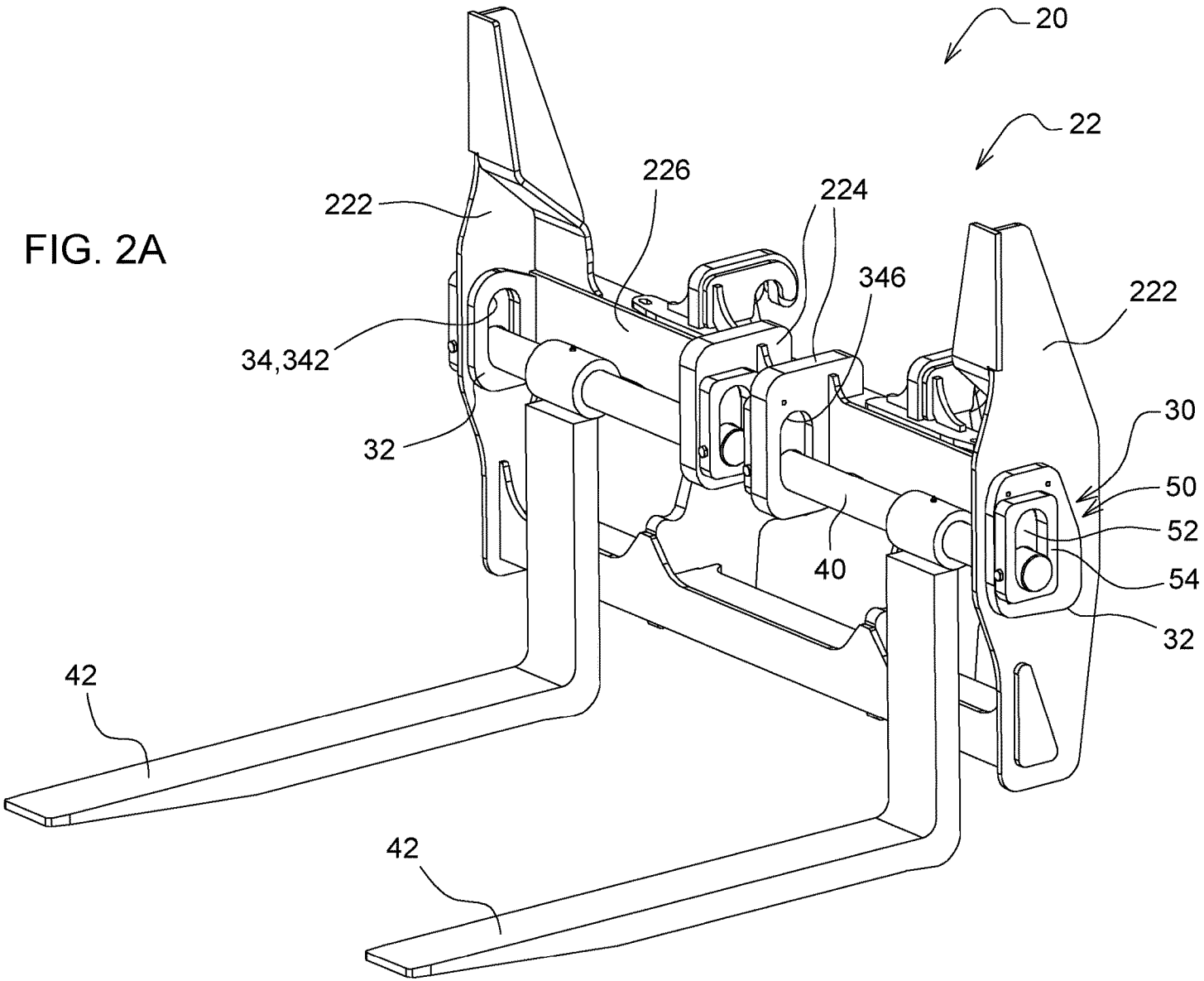
FIG. 2A is a perspective view of a first embodiment of a carriage.
Figure 2B:
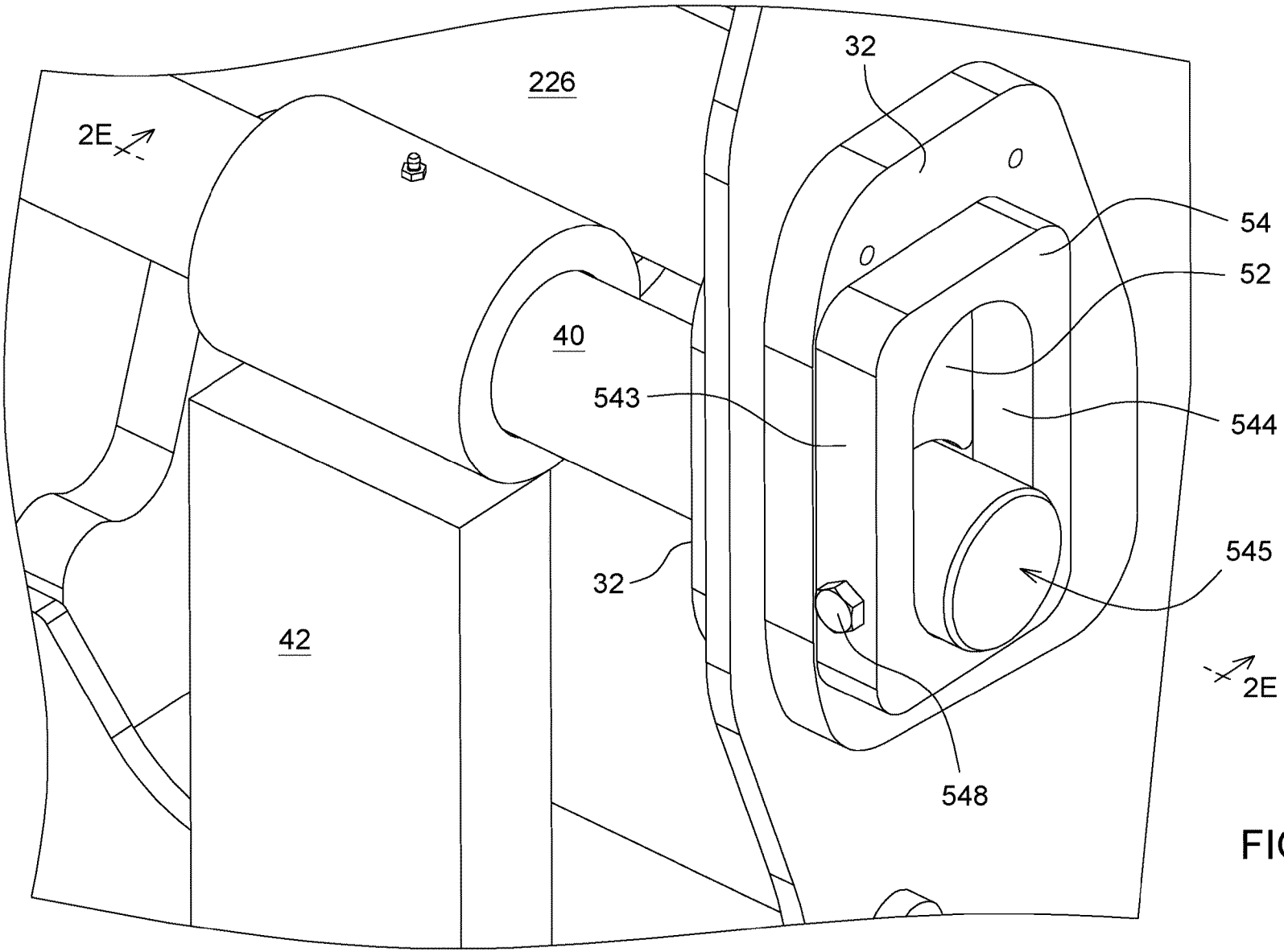
FIG. 2B is a partial perspective view of the first embodiment of the carriage.
Figure 2C:
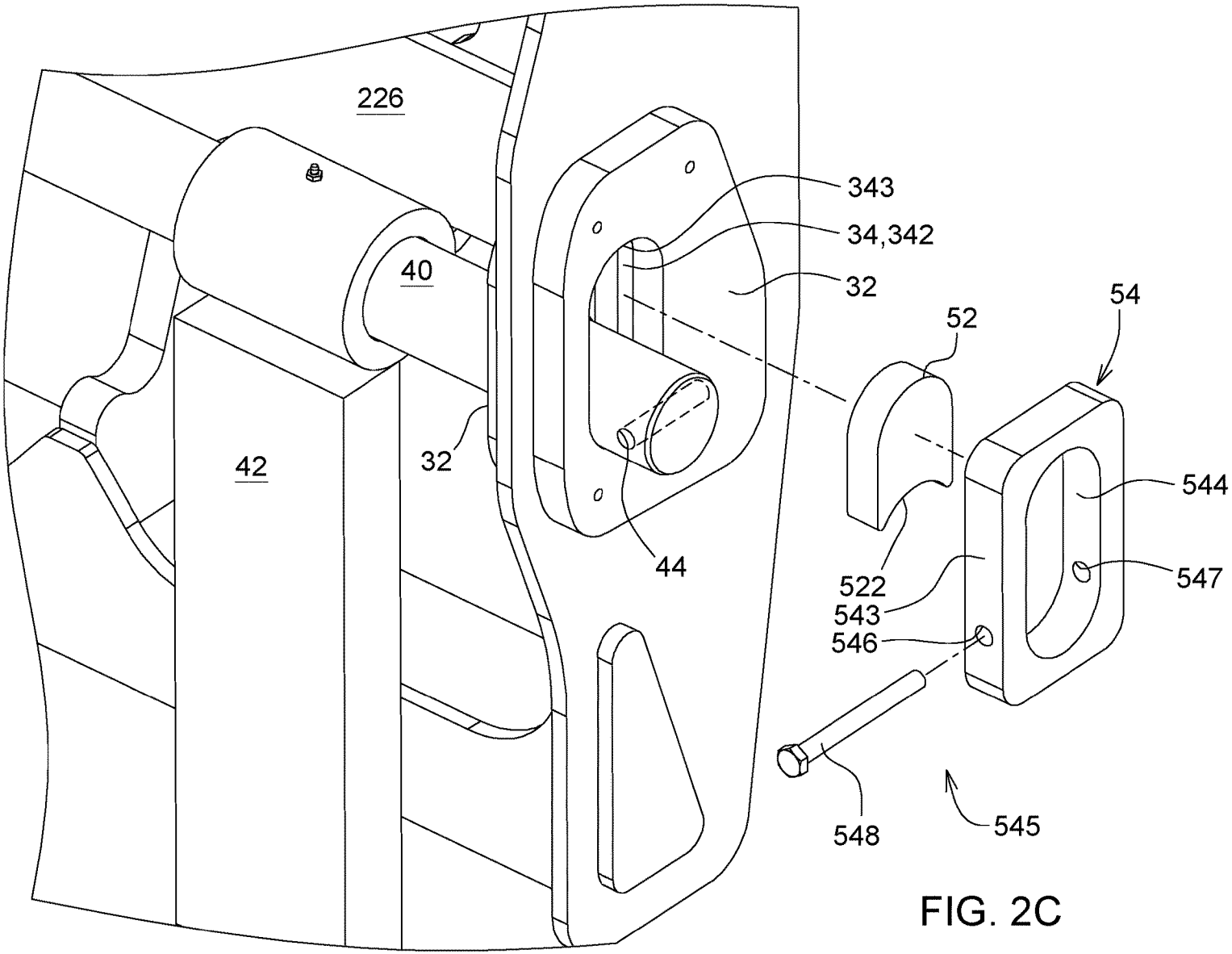
FIG. 2C is an exploded perspective view showing a retaining arrangement according to the first embodiment.

A convertible carriage 20 may include a carriage frame 22, a support arrangement 30, a shaft(s) 40, and a retaining arrangement 50. The carriage frame 22 comprises, as shown in FIG. 1, illustrates two sets, each set including a first member 222 and a second member 224. In another embodiment, the number of the set(s) can be one or more than two. The support arrangement 30 includes an elongate slot 34 and the support arrangement 30 is positioned on the carriage frame 22. For example, a lower edge of the elongate slot 34 may be used to support the shaft 40. The support arrangement 30, as shown in FIGS. 1 and 2A, comprises a first elongate slot 342 positioned on the first member 222 and a second elongate slot 346 positioned on the second member 224. With respect to each set including the first member 222 and the second member 224, one shaft 40 is positioned through the first elongate slot 342 and second elongate slot 346 and is moveable along the first elongate slot 342 and the second elongate slot 346 at least in the vertical dimension. The shaft 40 in following embodiments carries a tine 42, but in another embodiment, the shaft 40 may carry more than one tine 42. The tine 42 is configured as L shape, and the lower, horizontal part of the tine 42 is used to insert into a pallet (not shown) or beneath an object. It is noted that the two second members 224 of the both sets are coupled to a lateral member 226 which connects the two first members 222; however, in another implementation the second members 224 can be respectively coupled to another part of carriage frame 222. The retaining arrangement 50 is configured to selectively engaged with the elongate slot 34. Here, the number of the retaining arrangements 50 is two for each set comprising the first member 222 and the second member 224, and the two retaining arrangements 50 are respectively and selectively engaged with the first elongate slot 342 and the second elongate slot 346 to make the convertible carriage 20 convertible between first and second modes. The retaining arrangement 50 is engaged with the elongate slot 34 in a use position (second mode) and is disengaged with the elongate slot 34 in a non-use position (first mode). Different embodiments are shown in FIGS. 2A-4D.

Referring to FIGS. 2A-2E, which illustrate a first embodiment of convertible carriage 20.

Optionally, each support arrangement 30 may also additionally include at least one reinforcing plate 32 coupled to the first member 222 and/or second member 224 so as to increase the thickness of the edge of the first elongate slot 342 and/or the second elongate slot 346. The number of the reinforcing plates 32 can vary in configuration. As shown in FIG. 2A, there are two reinforcing plates 32 coupled to both sides of the first member 222 and one reinforcing plate 32 coupled to one side of the second member 224. The reinforcing plates 32 are coupled to the first member 222 and/or the second member 224 by welding, fastener, or other means. When the retaining arrangement 50 is removed from (is not engaged with) the first elongate slot 342 as the first mode, the shaft 40 is allowed to float in the first elongate slot 342 and the second elongate slot 346.

Figure 2D:
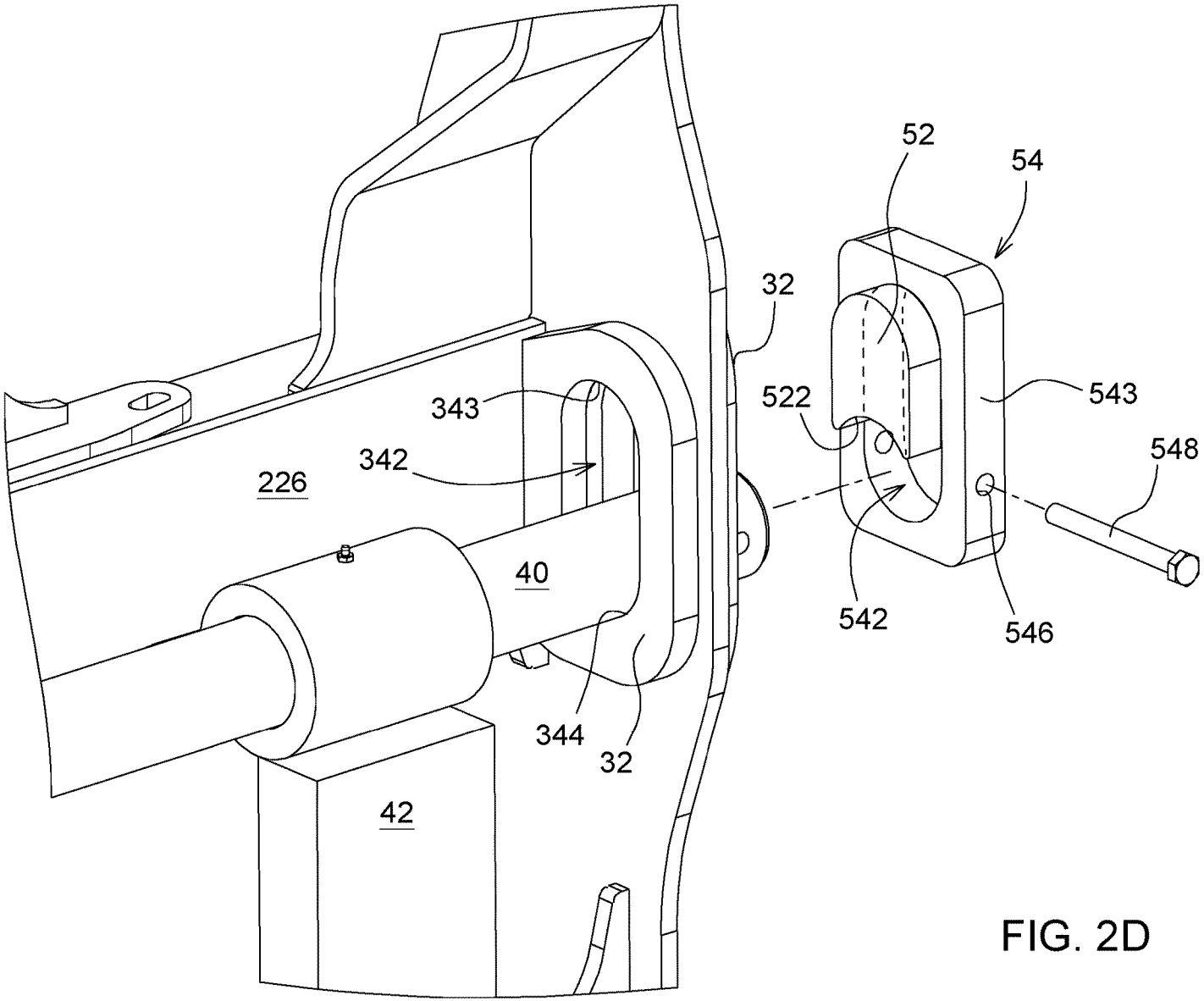
FIG. 2D is another exploded perspective view showing the retaining arrangement with a retainer and a holding piece coupled together according to the first embodiment.
Figure 2E:
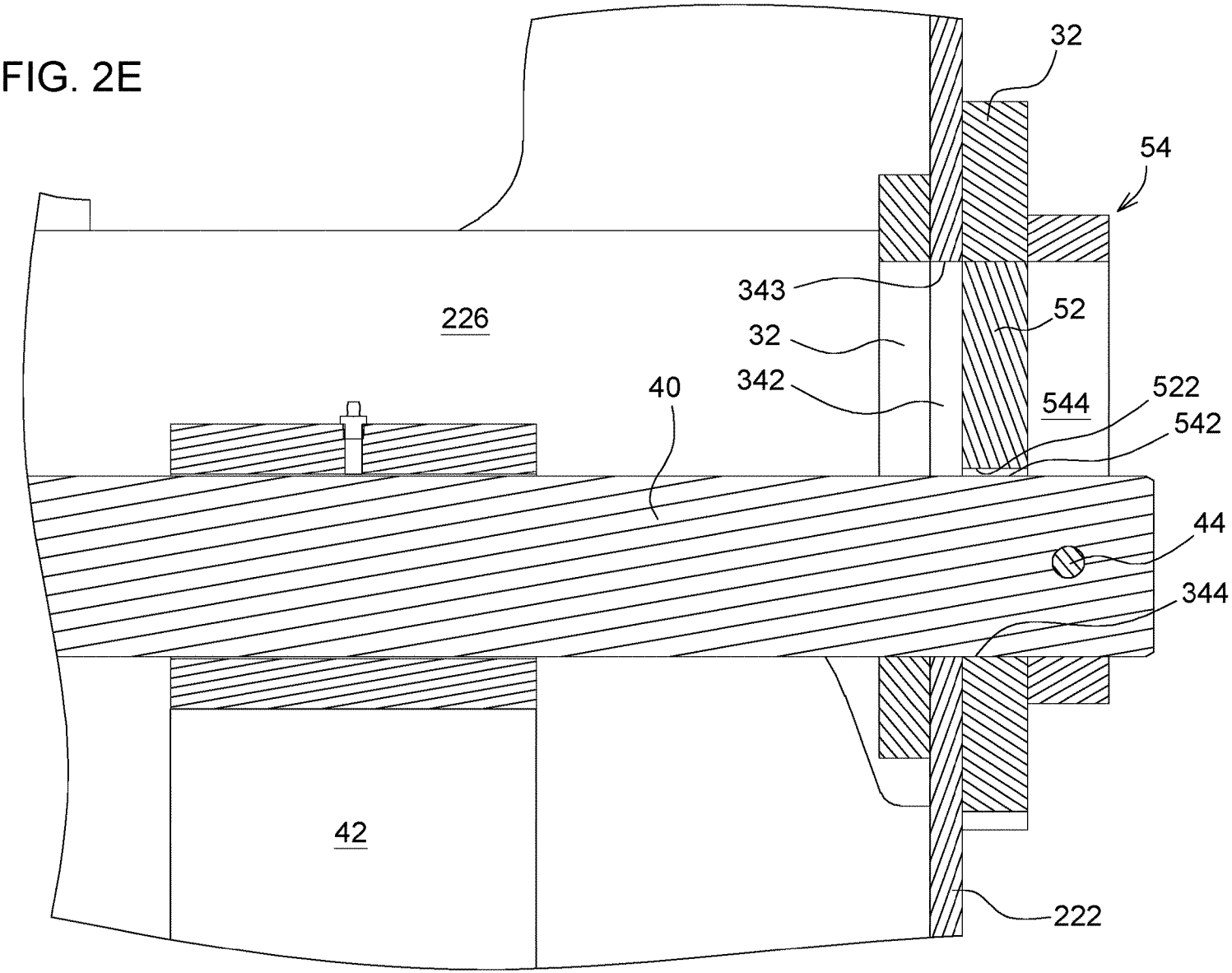
FIG. 2E is a cross-sectional view, taking along lines 2E-2E of FIG. 2B showing the carriage of the first embodiment.

For succinctness, only the first member 222 is shown instead of the second member 224, as shown in FIGS. 2B-2E. The retaining arrangement 50 may include a retainer 52 and a holding piece 54 coupled to the retainer 52. The retainer 52 and holding piece 54 are coupled together by welding in this embodiment but they may be coupled by other means. As shown in FIGS. 2D and 2E, the retainer 52 may be engaged with an upper portion 343 of the first elongate slot 342 to limit the shaft 40 from moving upward. However, in another embodiment, the retainer 52 may be engaged with a lower portion 344 of the first elongate slot 342 to limit the shaft from moving downward. Optionally, the retainer 52 comprises an edge 522 corresponding to a curvature of the shaft 40.

The holding piece 54 and the retainer 52 cooperate to form a retaining slot 542 through which the shaft 40 is positioned. The holding piece 54 comprises a first rib 543 and the second rib 544 opposite to the first rib 543, and the first rib 543, the second rib 544, and the retainer 52 defines the retaining slot 542. The retaining slot 542 (or retainer 52) and the first elongate slot 342 define a boundary. When the retaining arrangement 50 is engaged with the first elongate slot 342, a movement of the shaft 40 is limited by the retaining arrangement 50 within the boundary.

The holding piece 54 may also include a lock unit 545 configured to lock the shaft 40. The lock unit 545 may include a first lock hole 546 of the first rib 543 and a second lock hole 547 of the second rib 544, and a first fastener 548 positioned through the first lock hole 546, a hole 44 of the shaft 40, and the second lock hole 547 so as to lock the holding piece 54 on the shaft 40. In such configuration, the shaft 40 is prevented from moving axially relative to the holding piece 54. In this embodiment, as shown in FIG. 2A, the holding pieces 54 are arranged at both ends of shaft 40, and the shaft 40 is prevented from moving axially.

As described earlier, when the retaining arrangement 50 is engaged with the elongate slot 34, as the second mode, the movement of the shaft 40 is limited by the retaining arrangement 50 within the boundary defined at least by the retaining arrangement 50 and the elongate slot 34. Such limitation is resulted from the deduction of shaft moveable area, from the entire elongate slot 34 (minus the area occupied by the retainer 52) to the boundary. If the boundary is equal to the cross-sectional area of the shaft 40, that is, the retainer 52 is engaged with the elongate slot 34 (first elongate slot 342) via a press-fit and the shaft 40 is therefore fixed in the vertical direction. In another implementation, if the boundary is still larger than the cross-sectional area of the shaft 40, the shaft 40 is still movable but the movement is limited.

In the first embodiment, the retaining arrangement 50 not only prevents the shaft 40 from moving axially but also limits the shaft 40 from moving vertically in certain extent.

Figure 3A:
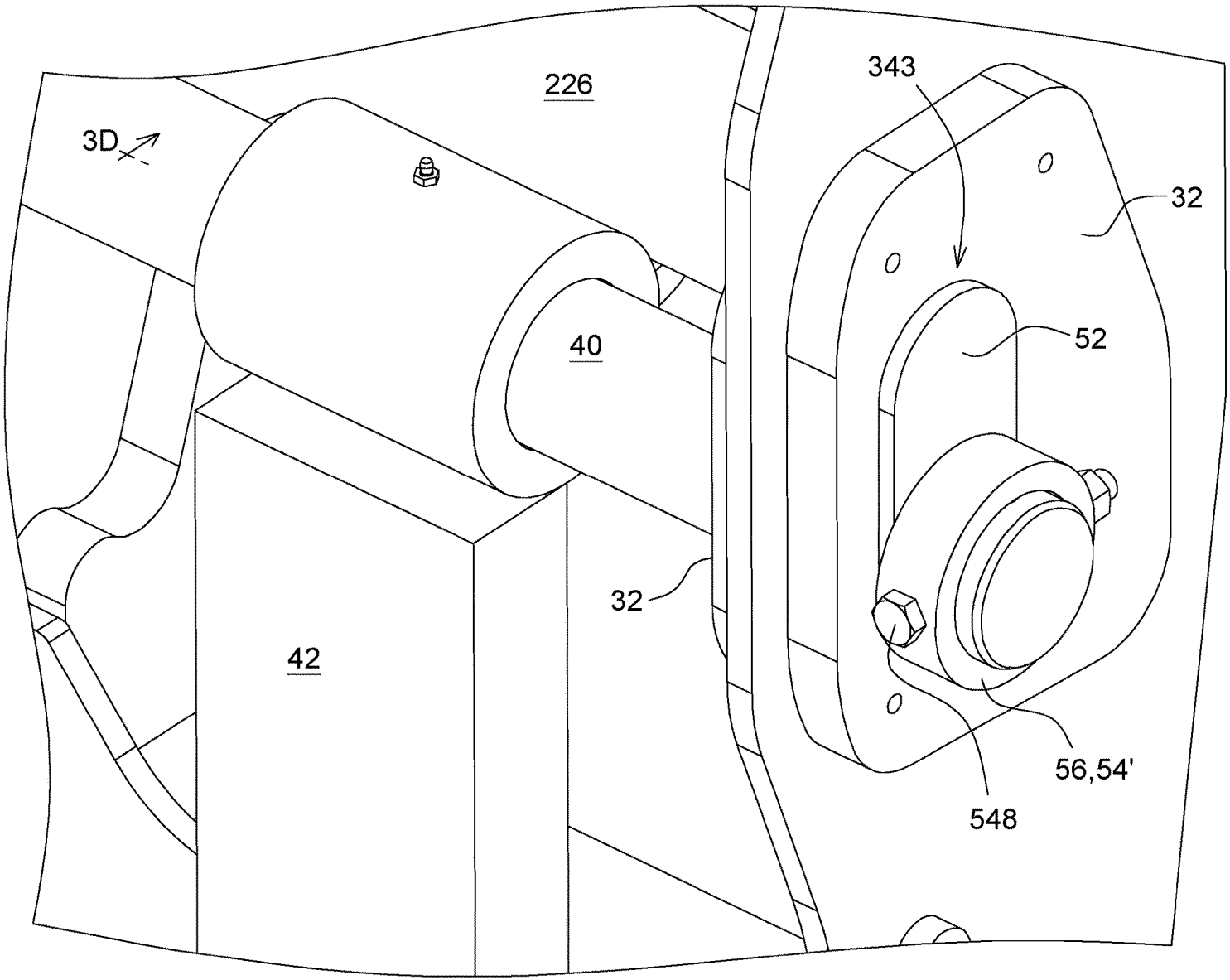
FIG. 3A is a perspective view of a second embodiment of a carriage.
Figure 3B:
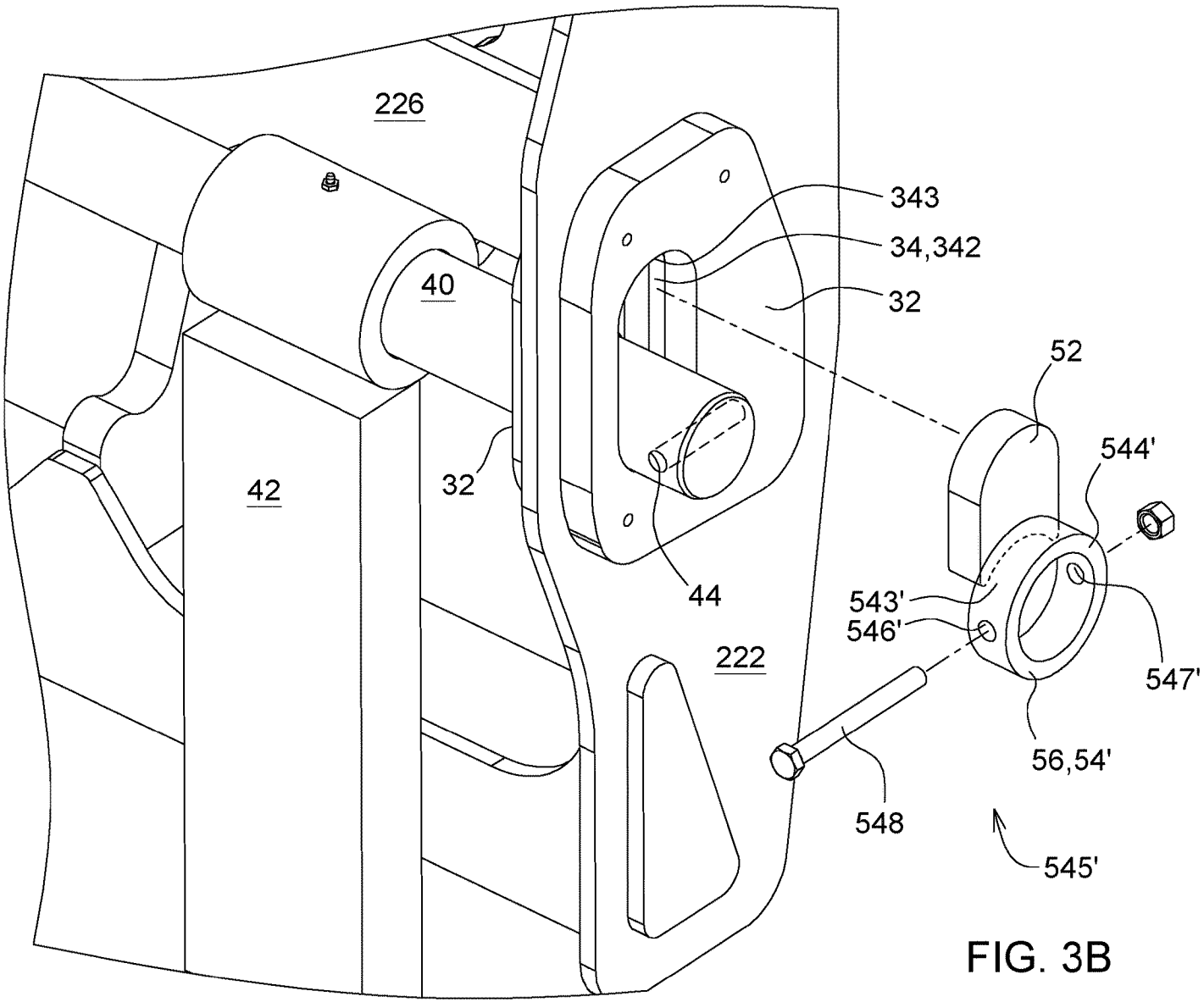
FIG. 3B is an exploded perspective view showing a retaining arrangement with a retainer and a holding piece coupled together according to the second embodiment.
Figure 3C:
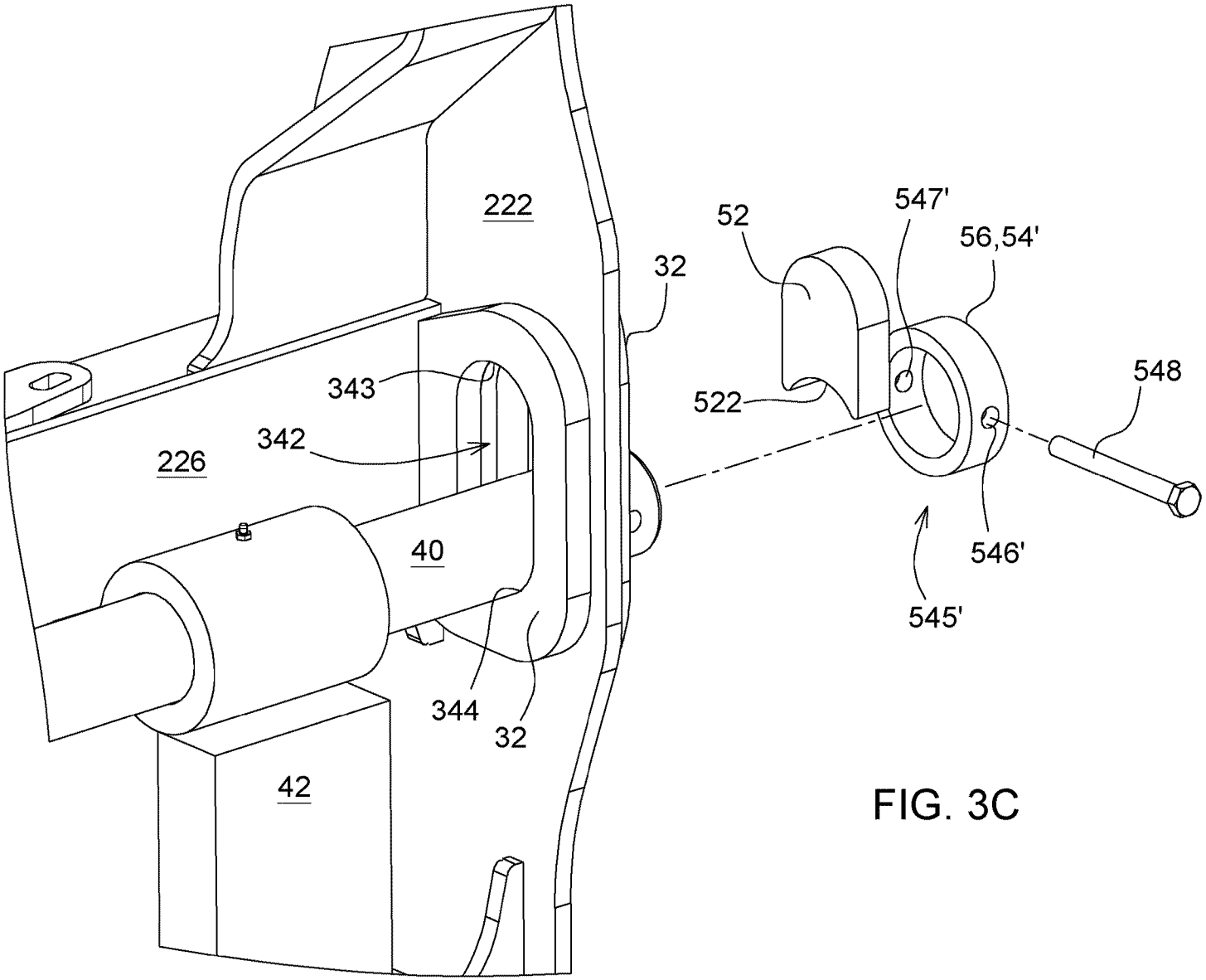
FIG. 3C is another exploded perspective view showing the retaining arrangement according to the second embodiment.
Figure 3D:
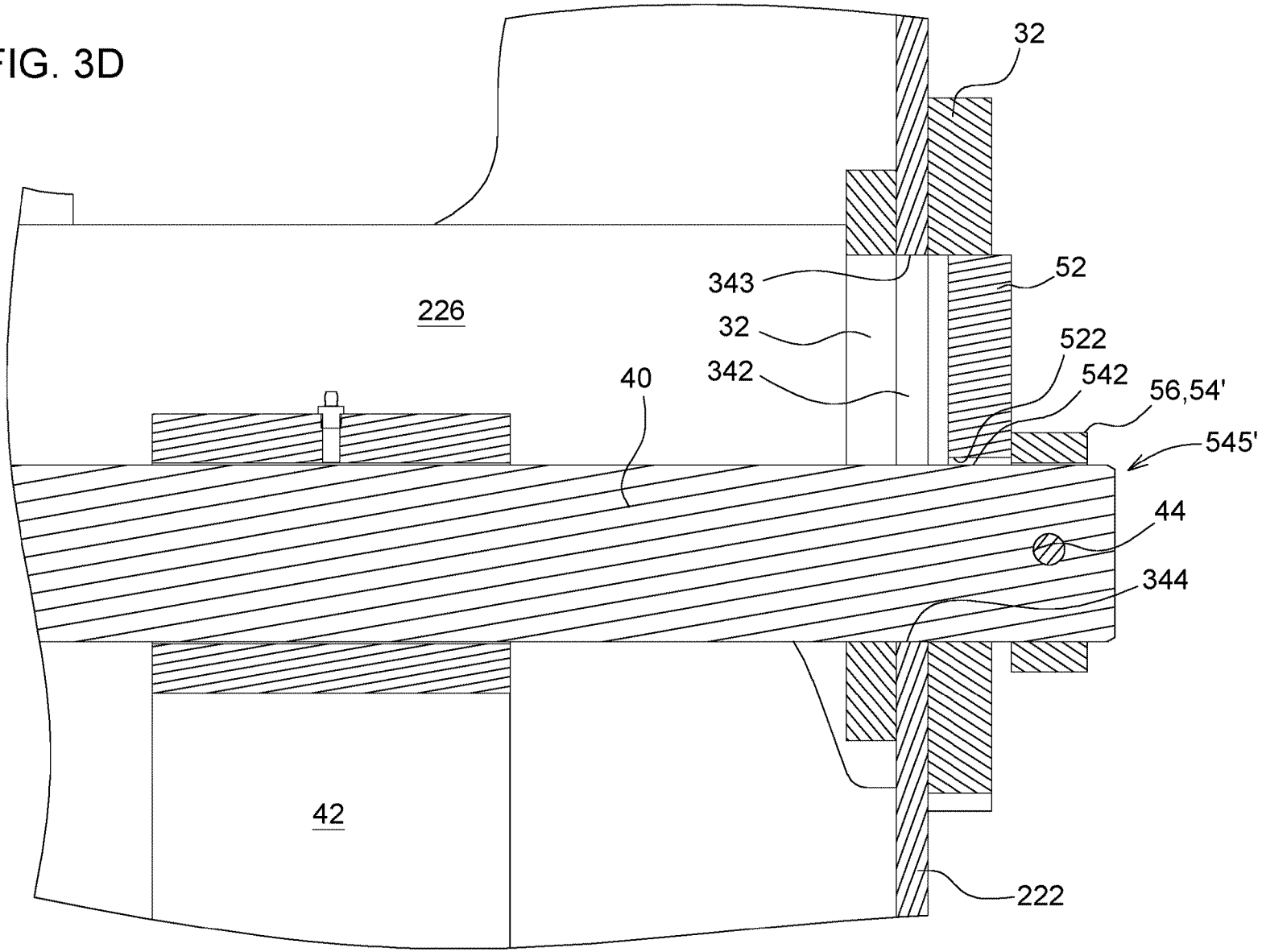
FIG. 3D is a cross-sectional view, taking along lines 3D-3D of FIG. 3A showing the carriage of the second embodiment.
Figure 4A:
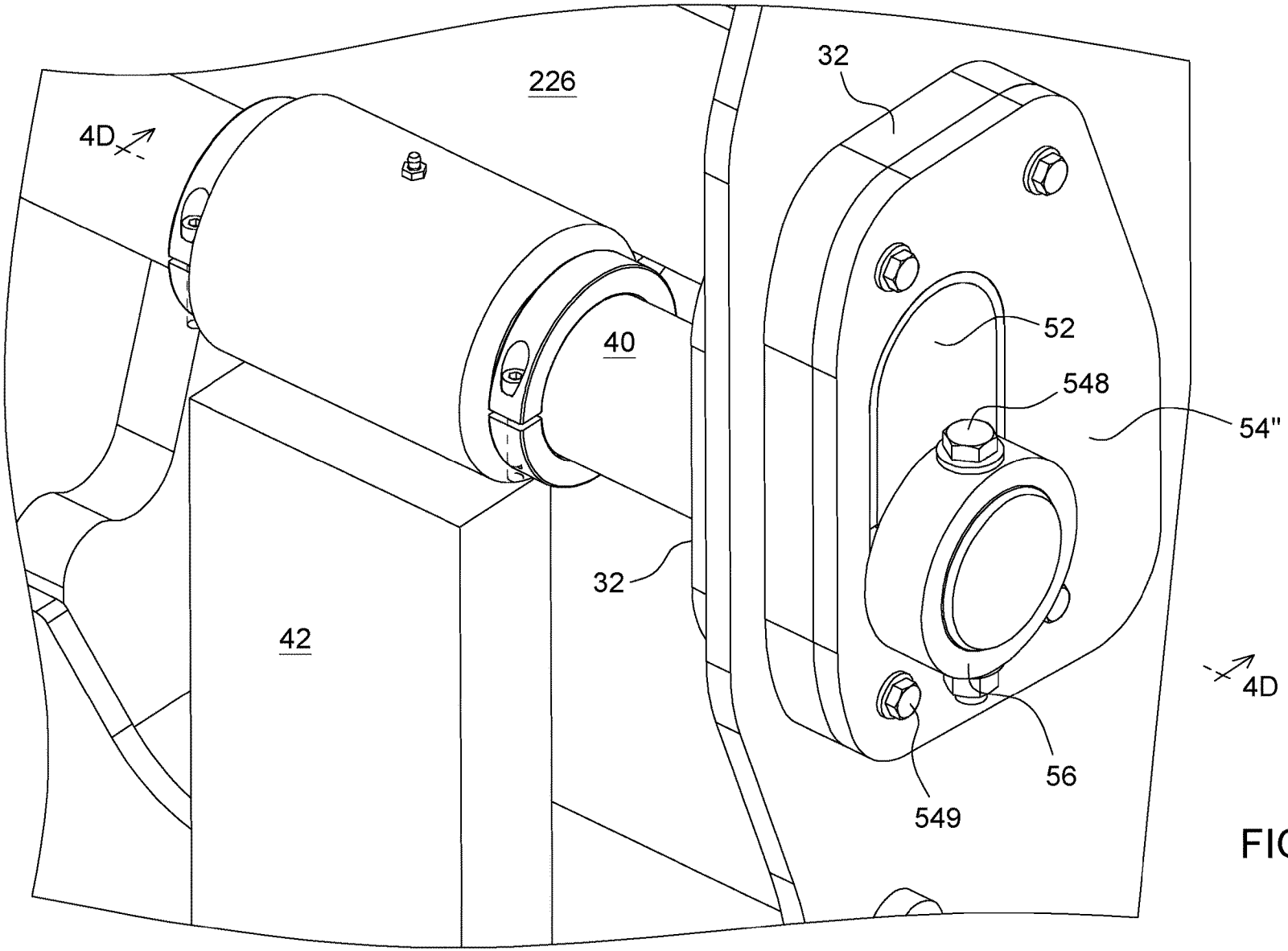
FIG. 4A is a perspective view of a third embodiment of a carriage.
Figure 4B:
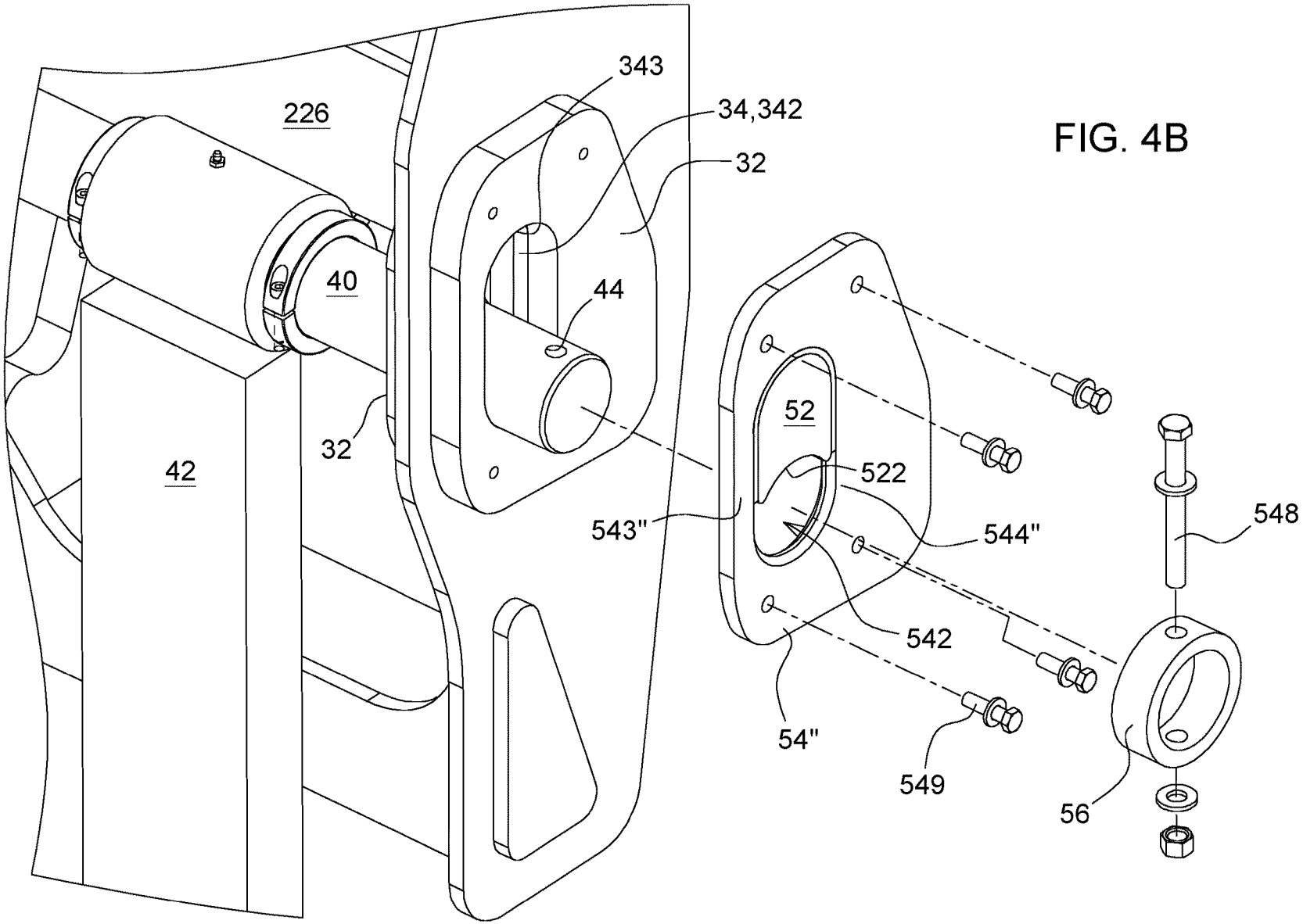
FIG. 4B is an exploded perspective view showing a retaining arrangement according to the third embodiment.
Figure 4C:
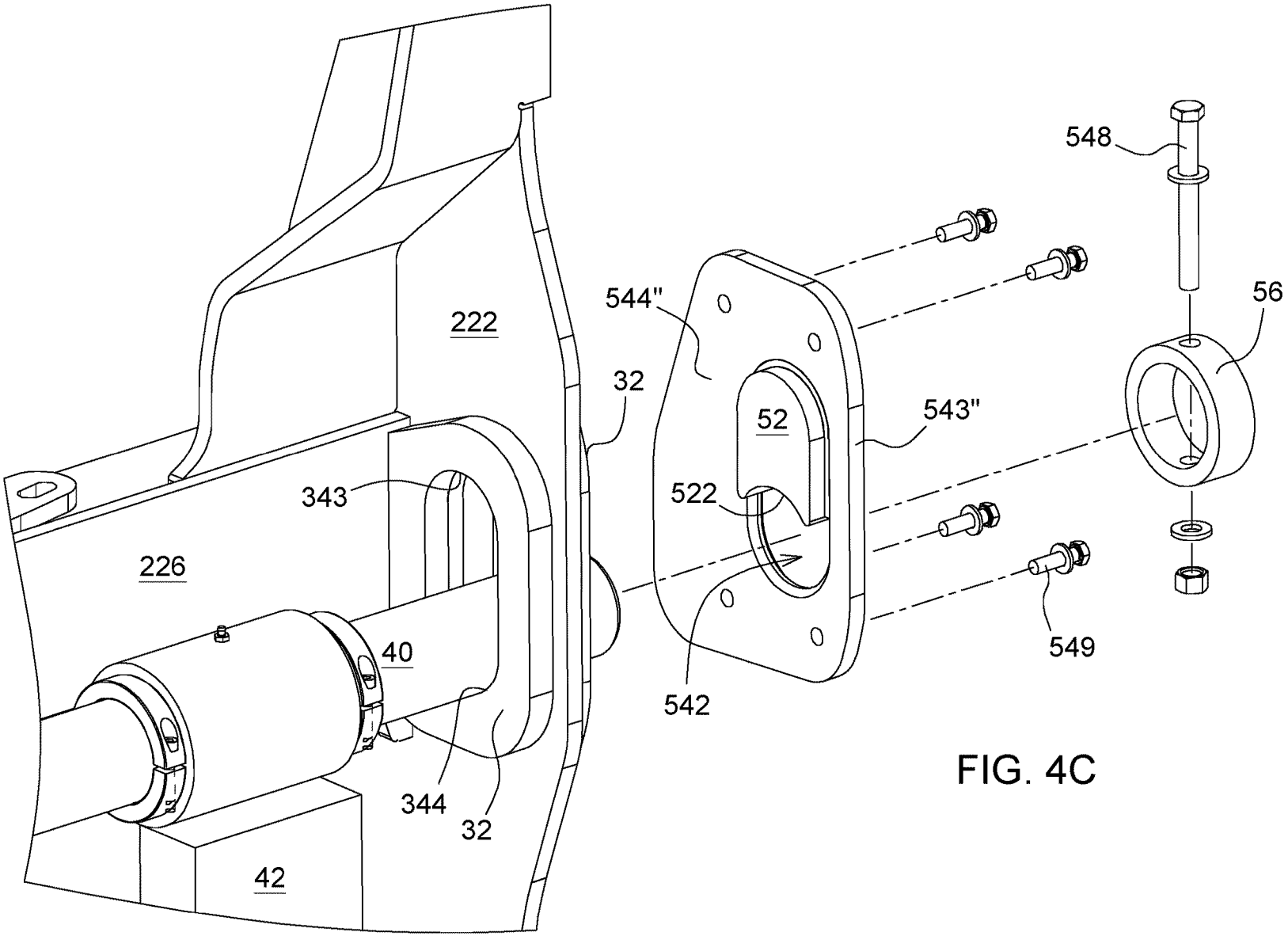
FIG. 4C is another exploded perspective view showing the retaining arrangement according to the third embodiment.
Figure 4D:
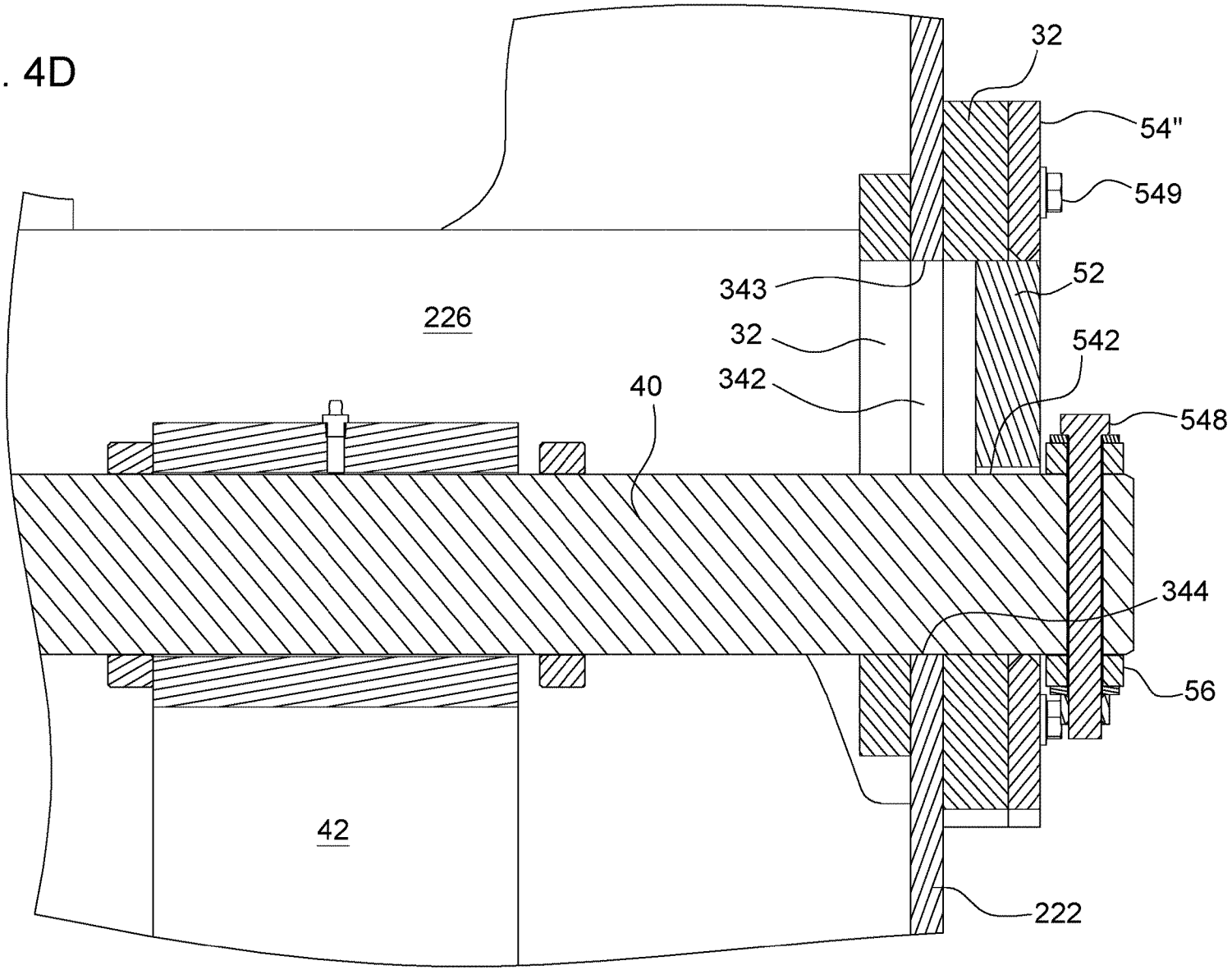
FIG. 4D is a cross-sectional view, taking along lines 4D-4D of FIG. 4A showing the carriage of the third embodiment.

Referring to FIGS. 3A-3D, which illustrate a second embodiment of convertible carriage 20. The carriage frame 22 (including the first, second, lateral members 222, 224, 226), the support arrangement 30 (including the reinforcing plates 32 and elongate slot 34), and the shaft 40 are similar to the first embodiment. As to the retaining arrangement 50, a holding piece 54' in the second embodiment is a shaft collar 56. The shaft collar 56 is coupled to the retainer 52 by welding or other means. The retainer 52 is configured to be engaged with the first elongate slot 342 so as to define the boundary, as shown in FIG. 3D. If the boundary is equal to the cross-sectional area of the shaft 40, that is, the retainer 52 is engaged with the elongate slot 34 (first elongate slot 342) via a press-fit and the shaft 40 is therefore fixed in the vertical direction. In another implementation, if the boundary is still larger than the cross-sectional area of the shaft 40, the shaft 40 is still movable but the movement is limited.

The shaft collar 56 (holding piece 54') may also include the lock unit 545' configured to lock the shaft 40. The lock unit 545' may include a first lock hole 546', a second lock hole 547' and a first fastener 548 positioned through the first lock hole 546', the hole 44 of the shaft 40, and the second lock hole 547' so as to lock the shaft collar 56 (holding piece 54') on the shaft 40. In such configuration, the shaft 40 is prevented from moving axially relative to the shaft collar 56 (holding piece 54').

Referring to FIGS. 4A-4D, which illustrate a third embodiment of convertible carriage 20. The carriage frame 22 (including the first, second, lateral members 222, 224, 226), the support arrangement 30 (including the reinforcing plates 32 and elongate slot 34), and the shaft 40 are similar to the first embodiment. As to the retaining arrangement 50, it includes the retainer 52 and a holding piece 54". The convertible carriage also included two shaft collars 56, each of which coupled to an end of the shaft 40 to prevent the shaft 40 from moving axially. Unlike the second embodiment, where the retainer 52 is coupled to the shaft collar 56 by welding, the retainer 52 in the third embodiment is coupled to the holding piece 54" by welding. When the retaining arrangement 50 is engaged with the first elongate slot 342, the retainer 52 is inserted into the first elongate slot 342, and the holding piece 54" is mounted on one of the reinforcing plates 32 by the second fasteners 549. The second fasteners 549 may be screws, screwed in corresponding threaded holes on the holding piece 54".

In all the embodiments, the reinforcing plates 32 and the retainer 52 may be configured in wide variety of ways. As described earlier, the elongate slot 34 is provided by the carriage frame 22, or the carriage frame 22 and one or two same or different reinforcing plates 32. The retainer 52 may be inserted into one reinforcing plate 32 only, or it may reach the first member 222 or the other reinforcing plate 32 in the opposite side of the first member 222.

Without in any way limiting the scope, interpretation, or application of the claims appearing below, a technical effect of one or more of the example embodiments disclosed herein is provide a convertible carriage of which the shaft can float in the elongate slot(s) or it's movement can be limited or prohibited in the vertical direction when the retaining arrangements are engaged. Another technical effect of one or more of the example embodiments disclosed herein is to lock the shaft of the convertible carriage in the axial direction may simultaneous limit, as needed, the shaft from moving vertically.

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A convertible carriage, comprising:

a carriage frame;

a support arrangement comprising an elongate slot, the support arrangement being positioned on the carriage frame;

a shaft configured to carry a tine and to be moveable along the elongate slot at least in a vertical dimension; and a retaining arrangement configured to selectively engage with the elongate slot;

wherein when the retaining arrangement is engaged with the elongate slot, a movement of the shaft is limited by the retaining arrangement with a boundary defined at least by the retaining arrangement, and when the retaining arrangement is removed from the elongate slot, the shaft is allowed to float in the elongate slot.

2. The convertible carriage of claim 1, wherein the retaining arrangement comprises a retainer engaged with one of an upper portion of the elongate slot to limit the shaft from moving upward or a lower portion of the elongate slot to limit the shaft from moving downward when the retaining arrangement is engaged with the elongate slot.

3. The convertible carriage of claim 2, wherein the retainer comprises an edge corresponding to a curvature of the shaft.

4. The convertible carriage of claim 2, wherein the retainer is engaged with the elongate slot and the shaft via a press-fit.

5. The convertible carriage of claim 1, wherein the retaining arrangement comprises a retainer and a holding piece coupled to the retainer, and the holding piece and the retainer cooperate to form a retaining slot through which the shaft is positioned.

6. The convertible carriage of claim 5, wherein when the retaining arrangement is engaged with the elongate slot, the holding piece is coupled to the carriage frame via a second fastener, and the retainer is engaged with the elongate slot.

7. The convertible carriage of claim 6, comprising a shaft collar coupled to an end of the shaft so as to lock the shaft, wherein the holding piece is positioned between the shaft collar and the carriage frame when the retaining arrangement is engaged with the elongate slot.

8. The convertible carriage of claim 5, wherein the holding piece comprises a lock unit configured to lock the shaft.

9. The convertible carriage of claim 8, wherein the holding piece comprises a first rib and a second rib opposite to the first rib, and the first rib and the second rib partially define the retaining slot, the lock unit comprises a first lock hole of the first rib and a second lock hole of the second rib, and a first fastener positioned through the first lock hole, the shaft, and the second lock hole.

10. The convertible carriage of claim 5, wherein the retaining slot and the elongate slot define the boundary.

11. The convertible carriage of claim 1, wherein the retaining arrangement comprises a retainer and a shaft collar coupled to the retainer, the shaft collar is coupled to an end of the shaft so as to lock the shaft, and the retainer is configured to be engaged with the elongate slot so as to define the boundary.

12. The convertible carriage of claim 1, wherein the support arrangement includes a reinforcing plate mounting on the carriage frame, wherein the reinforcing plate comprises the elongate slot.

13. The convertible carriage of claim 1, wherein the carriage frame comprises a set comprising a first member and a second member, the support arrangement comprises a first elongate slot positioned on the first member and a second elongate slot positioned on the second member, the shaft is positioned through the first elongate slot and second elongate slot and is moveable along the first elongate slot and the second elongate slot at least in the vertical dimension.

14. The convertible carriage of claim 13, wherein the carriage frame comprises another set comprising the first member and the second member with another shaft positioned through.

15. A retaining arrangement selectively coupled to a convertible construction carriage having a carriage frame, an elongate slot positioned on the carriage frame, and a shaft configured to carry a tine and to be moveable along the elongate slot at least in a vertical dimension, the retaining arrangement comprising:

a retainer configured to be engaged with one of an upper portion of the elongate slot to limit the shaft from moving upward or a lower portion of the elongate slot to limit the shaft from moving downward.

16. The retaining arrangement of claim 15, comprising a holding piece coupled to the retainer, wherein the holding piece and the retainer cooperate to form a retaining slot through which the shaft is positioned.

17. The retaining arrangement of claim 16, wherein the holding piece is coupled to the carriage frame via a second fastener when the retainer is engaged with the elongate slot.

18. The retaining arrangement of claim 16, wherein the holding piece comprises a lock unit configured to lock the shaft.

19. The retaining arrangement of claim 16, wherein the holding piece comprises a first rib and a second rib opposite to the first rib, and the first rib and the second rib partially define the retaining slot, the lock unit comprises a first lock hole of the first rib and a second lock hole of the second rib, and a first fastener positioned through the first lock hole, the shaft, and the second lock hole.

20. The retaining arrangement of claim 16, wherein the retaining arrangement comprises a retainer and a shaft collar coupled to the retainer, the shaft collar is coupled to an end of the shaft so as to lock the shaft, and the retainer is configured to be engaged with the elongate slot so as to define the boundary.

* * * * *